US010302086B2

(12) United States Patent
Yang et al.

(10) Patent No.: US 10,302,086 B2
(45) Date of Patent: May 28, 2019

(54) EXHAUST BEARING SEAT, SCREW COMPRESSOR AND AIR-CONDITIONING UNIT

(71) Applicant: GREE ELECTRIC APPLIANCES, INC. OF ZHUHAI, Zhuhai, Guangdong (CN)

(72) Inventors: Qiaoming Yang, Guangdong (CN); Rihua Li, Guangdong (CN); Tianyi Zhang, Guangdong (CN); Guanghui Xia, Guangdong (CN); Gongsheng Tan, Guangdong (CN); Weijun Lin, Guangdong (CN); Hao Long, Guangdong (CN); Yushi Bi, Guangdong (CN); Yanhai Peng, Guangdong (CN); Kang Xu, Guangdong (CN)

(73) Assignee: Gree Electric Appliances, Inc. of Zhuhai, Zhuhai, Guangdong (CN)

( * ) Notice: Subject to any disclaimer, the term of this patent is extended or adjusted under 35 U.S.C. 154(b) by 155 days.

(21) Appl. No.: 15/510,779

(22) PCT Filed: Dec. 26, 2014

(86) PCT No.: PCT/CN2014/095091
§ 371 (c)(1),
(2) Date: Mar. 13, 2017

(87) PCT Pub. No.: WO2016/041287
PCT Pub. Date: Mar. 24, 2016

(65) Prior Publication Data

US 2017/0276137 A1 Sep. 28, 2017

(30) Foreign Application Priority Data

Sep. 19, 2014 (CN) ..... 2014 1 0484100

(51) Int. Cl.
*F04C 18/16* (2006.01)
*F04C 19/00* (2006.01)
(Continued)

(52) U.S. Cl.
CPC ..... *F04C 29/06* (2013.01); *F04C 18/16* (2013.01); *F04C 19/004* (2013.01);
(Continued)

(58) Field of Classification Search
CPC ..... F04C 18/16; F04C 19/004; F04C 19/005; F04C 29/02; F04C 29/06; F04C 29/12
See application file for complete search history.

(56) References Cited

U.S. PATENT DOCUMENTS 2,474,653 A * 6/1949 Boestad ..... F04C 18/16 418/201.1
4,180,089 A 12/1979 Webb
(Continued)

FOREIGN PATENT DOCUMENTS

CN 1670376 A 9/2005
CN 101892988 A 11/2010
(Continued)

OTHER PUBLICATIONS

Supplementary European Search Report, European Patent Office, Application No. EP14902267, PCT/CN2014095091, dated Jan. 23, 2018, 8 pages.
(Continued)

*Primary Examiner* — Mary Davis
(74) *Attorney, Agent, or Firm* — Faegre Baker Daniels LLP

(57) ABSTRACT

An exhaust bearing seat, a screw compressor and an air-conditioning unit are provided. The exhaust bearing seat is provided with a discharge port, wherein an opening of the discharge port is orientated in such a way that, if the exhaust
(Continued)

bearing seat is sheathed in a housing, gas exhausted from the discharge port has a component which rotates along an inner wall of the housing and around an axial direction of the housing. The discharge port is able to guide the gas flow to rotationally flow along the inner wall of the housing body and around the axial direction of the housing, which extends the flow path of the gas flow inside the housing, and facilitates the reduction of noise of the gas flow pulsation.

13 Claims, 3 Drawing Sheets

(51) Int. Cl.
*F04C 29/02* (2006.01)
*F04C 29/06* (2006.01)
*F04C 29/12* (2006.01)

(52) U.S. Cl.
CPC ..... *F04C 19/005* (2013.01); *F04C 29/02* (2013.01); *F04C 29/12* (2013.01)

(56) References Cited

U.S. PATENT DOCUMENTS

| | | | | |
|---|---|---|---|---|
| 6,520,758 | B1 | 2/2003 | Sowards | |
| 7,052,259 | B2 * | 5/2006 | Nachi | F04C 18/16 418/206.1 |
| 8,142,172 | B2 * | 3/2012 | Forster | F04C 29/061 181/403 |
| 9,169,840 | B2 | 10/2015 | Yonemoto et al. | |
| 9,568,003 | B2 | 2/2017 | Yonemoto et al. | |
| 2010/0028165 | A1 | 2/2010 | Kameya et al. | |

FOREIGN PATENT DOCUMENTS

| | | | | |
|---|---|---|---|---|
| CN | 201896750 | U | 7/2011 | |
| CN | 202100461 | U | 1/2012 | |
| CN | 203272132 | U | 11/2013 | |
| CN | 103821714 | A | 5/2014 | |
| CN | 203796572 | U | 8/2014 | |
| CN | 104265634 | A | 1/2015 | |
| CN | 204113656 | U | 1/2015 | |
| DE | 102005014922 | A1 * | 10/2006 | F04C 29/12 |
| EP | 2505841 | A2 | 10/2012 | |
| JP | H09291891 | A | 11/1997 | |
| TW | M421987 | U | 2/2012 | |
| WO | WO2014045684 | A1 | 3/2014 | |
| WO | WO 2018117276 | A1 * | 6/2018 | |

OTHER PUBLICATIONS

International Search Report and Written Opinion (in Chinese language), issued by the State Intellectual Property Office of the Peoples Republic of China, dated May 20, 2015, for International Application No. PCT/CN2014/095091(includes English translation of the International Search Report); 11 pages.

State Intellectual Property Office of People's Republic of China, First Office Action, Application No. 201410484100.6, dated Dec. 12, 2015, English translation, 4 pages.

State Intellectual Property Office of People's Republic of China, Notification to Grant Patent Right for Invention, Applicaton No. 201410484100.6, dated Apr. 26, 2016, English translation, 1 page.

* cited by examiner

EXHAUST BEARING SEAT, SCREW COMPRESSOR AND AIR-CONDITIONING UNIT

This application is a National Phase entry of PCT Application No. PCT/CN2014/095091, filed Dec. 26, 2014, which claims the priority to Chinese Patent Application No. 201410484100.6, titled "EXHAUST BEARING SEAT, SCREW COMPRESSOR AND AIR-CONDITIONING UNIT", filed with the Chinese State Intellectual Property Office on Sep. 19, 2014, the entire disclosures of which are incorporated herein by reference.

TECHNICAL FIELD

The present application relates to the field of compressor, and particularly to an exhaust bearing seat, a screw compressor and an air-conditioning unit.

BACKGROUND

In a semi-closed screw compressor, in the case that the compressor is not provided with a built-in oil separating cartridge, that an exhaust bearing seat is surrounded by an oil separating barrel may reduce noise. In this case, gas generated from the compressor flows into an interior of the oil separating barrel through the exhaust bearing seat, and then is discharged from the compressor by a discharge port of the oil separating barrel. As the compressor is not provided with the built-in oil separating cartridge, it is necessary to locate the discharge port of the oil separating barrel at a lower part such that refrigeration oil carried in the exhaust gas can be smoothly exhausted from the compressor. However, for a screw compressor with a slide valve structure positioned in a lower part, an exhaust port of the exhaust bearing seat is generally located at the lower part of the exhaust bearing seat. In this case, a distance between the exhaust port of the exhaust bearing seat and the discharge port of the oil separating barrel is too small, and the oil separating barrel cannot sufficiently isolate the noise.

SUMMARY

An object of the present application is to provide an exhaust bearing seat, a screw compressor and an air-conditioning unit, which facilitates reducing noise from the gas flow pulsation.

To achieve the above object, an exhaust bearing seat is provided according to the present application. The exhaust bearing seat is provided with an exhaust port. An opening of the exhaust port is orientated in a way that, in the case that an exhaust bearing seat is sheathed in a housing, gas exhausted from the exhaust port has a component which rotationally flows along an inner wall of the housing and around an axis of the housing.

In a preferred or optional embodiment, the opening of the exhaust port is orientated to be substantially perpendicular to an axis of a male rotor bearing chamber or an axis of a female rotor bearing chamber in the exhaust bearing seat.

In a preferred or optional embodiment, the exhaust port is inclined upward to allow gas flow exhausted form the exhaust port to flow obliquely upward.

In a preferred or optional embodiment, the opening of the exhaust port includes an exhaust port upper edge and an exhaust port lower edge. The exhaust port upper edge is an arc, and a tangent line of the arc and a horizontal plane form an opening inclination angle θ1 greater than 0 degree, the exhaust port lower edge is also an arc, and a tangent line of the arc and a horizontal plane form an opening inclination angle θ2 greater than 0 degree.

In a preferred or optional embodiment, an oil return hole is provided in the exhaust bearing seat at a position close to the exhaust port upper edge. On the premise that the oil return hole has a safe wall thickness, the opening inclination angle θ1 of the exhaust port upper edge is set as large as possible, and the opening inclination angle θ2 of the exhaust port lower edge is smaller than the opening inclination angle θ1 of the exhaust port upper edge by 5 degrees to 10 degrees.

In a preferred or optional embodiment, the opening inclination angle θ1 of the exhaust port upper edge ranges from 25 degrees to 65 degrees, the opening inclination angle θ2 of the exhaust port lower edge is smaller than the opening inclination angle θ1 of the exhaust port upper edge by 5 degrees to 10 degrees.

In a preferred or optional embodiment, the opening of the exhaust port is located at a side of the male rotor bearing chamber in the exhaust bearing seat.

To achieve the above object, a screw compressor is further provided according to the present application. The screw compressor includes an oil separating barrel having a discharge port. The screw compressor further includes the exhaust bearing seat according to any one of above embodiments, and the exhaust bearing seat is sheathed in the oil separating barrel.

In a preferred or optional embodiment, the discharge port of the oil separating barrel is offset from the opening of the exhaust port of the exhaust bearing seat in a horizontal direction.

To achieve the above object, an air-conditioning unit is further provided according to the present application. The air-conditioning unit includes the screw compressor according to any one of above embodiments.

Based on the above technical solutions, the present application at least has the following beneficial effects.

The exhaust port provided in the exhaust bearing seat according to the present application can guide the gas flow to rotationally flow along the inner wall of the housing and around the axis of the housing, which extends the flow path of the gas flow in the housing, and facilitates reducing the noise from the gas flow pulsation.

BRIEF DESCRIPTION OF THE DRAWINGS

The, drawings described here are intended to facilitate a further understanding to the present application, and constitute a part of the present application. The exemplary embodiments of the present application and the description thereof are used to explain the present application, and are not intended to unduly limit the present application. In the drawings.

DETAILED DESCRIPTION OF THE EMBODIMENTS

Figure 1:
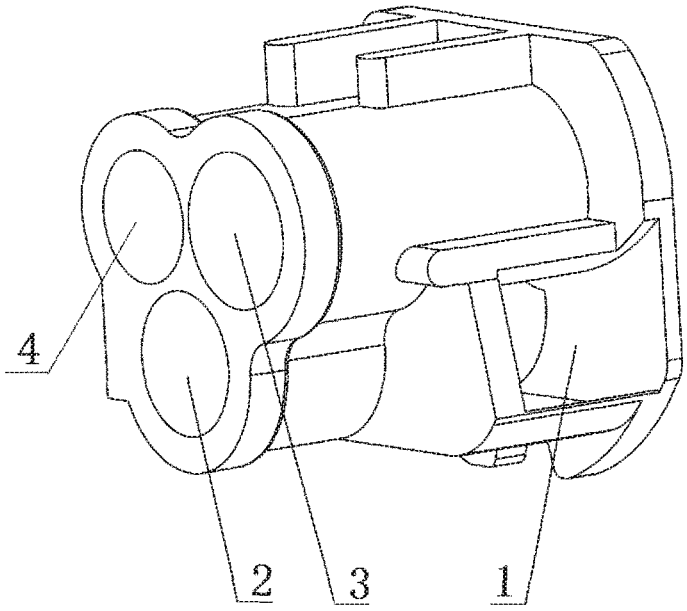
FIG. 1 is a schematic perspective view showing the structure of an exhaust bearing seat according to the present application.

The technical solutions of embodiments of the present application will be clearly and completely described hereinafter in conjunction with the drawings of the embodiments of to the present application. Apparently, the embodiments described below are only some examples of the present application, and not all implementations. Other embodiments obtained by those skilled in the art based on the embodiments of the present application without any creative efforts all fall into the scope of the present application.

In the description of the present application, it is to be understood that the orientation or positional relationships indicated by terms "center", "longitudinal", "lateral", "front", "rear", "left", "right", "vertical", "horizontal", "top", "bottom", "inner", "outer" and the like are based on the orientation or positional relationships shown in the drawings, which are merely for the convenience of describing the present application and the simplification of the description, and do not indicate or imply that the device or element referred to must be in a particular orientation, or be constructed and operated in a particular orientation. Therefore the terms should not be construed as limiting the scope of the present application.

Reference is made to FIG. 1, which is a schematic perspective view showing the structure of an exemplary embodiment of an exhaust bearing seat according to the present application. In the exemplary embodiment, the exhaust bearing seat includes a piston chamber 2, a male rotor bearing chamber 3 and a female rotor bearing chamber 4, and further includes an exhaust port 1 provided in the exhaust bearing seat. The exhaust port 1 is in communication with an exhaust end of the piston chamber 2. An opening, of the exhaust port 1 is orientated in such a way that, in the case that the exhaust bearing seat is sheathed in a housing, gas exhausted from the exhaust port 1 has a component which rotationally flows along an inner wall of the housing and around an axis of the housing. In other words, at least a portion of gas flow can rotationally flow along the inner wall of the housing and around the axis of the housing. The above housing may be a housing for an oil separating barrel.

In an exemplary embodiment of the exhaust bearing seat provided according to the present application, the opening of the exhaust port 1 can be orientated to be strictly and absolutely perpendicular to or substantially perpendicular to an axis of the piston chamber 2, an axis of the male rotor bearing chamber 3 or an axis of the female rotor bearing chamber 4 provided in the exhaust bearing seat. The opening of the exhaust port 1 can be inclined upward and have a preset inclination angle, such that the gas flow exhausted through the exhaust port 1 has an obliquely upward flowing velocity.

In the exhaust bearing seat according to the present application, the exhaust port 1 is configured in such a way that the opening thereof is inclined upward and has a preset inclination angle, which enables the gas to be at a particular circumferential velocity when being exhausted from the exhaust port 1, such that the gas flow exhausted through the exhaust bearing seat can rotationally flow along an inner wall of the oil separating barrel, which extends a flow path of the gas flow inside the oil separating barrel, facilitates the reduction of noise, and also facilitates better separating the refrigerants from lubricants.

In an exemplary embodiment of the exhaust bearing seat according to the present application, the exhaust port 1 can be located at a side of the piston chamber 2 and the male rotor bearing chamber 3. This is in view of the fact that a side of the female rotor bearing chamber 4 and the piston chamber 2 is generally used for arranging an oil supply passage for the piston chamber, and that the exhaust bearing seat is closer to the side of the female rotor in an overall arrangement of the exhaust bearing seat to a body of the compressor, which is determined by the fact that a male rotor drives a female rotor. Accordingly, an axial space on the side of the piston chamber 2 and the male rotor bearing chamber 3 is relatively larger, which facilitates the arrangement of the exhaust port 1.

In an exemplary embodiment of an exhaust bearing seat according to the present application, the exhaust port 1 has an upwardly inclined opening, and the particular inclination angle of the opening is related to a practical configuration of the compressor, and it is desired that the inclination angle is as large as possible. This is because that the gas, after flowing out of the exhaust bearing seat, needs to be deflected upward first to flow along the inner wall of the oil separating barrel, and if the flowing direction is changed in a too large degree, the flowing loss of the gas flow will be high; and the larger the upward inclination angle is, the less the flowing direction change of the gas after exhausted from the exhaust bearing seat will be, and thus the less the flowing loss will be. In addition, it is also necessary to ensure that the area of the exhaust port 1 is sufficiently large thus the velocity of flow can be effectively reduced to a certain flow rate, thereby the resistance and flowing loss can be reduced and the noise can be reduced.

Figure 2:
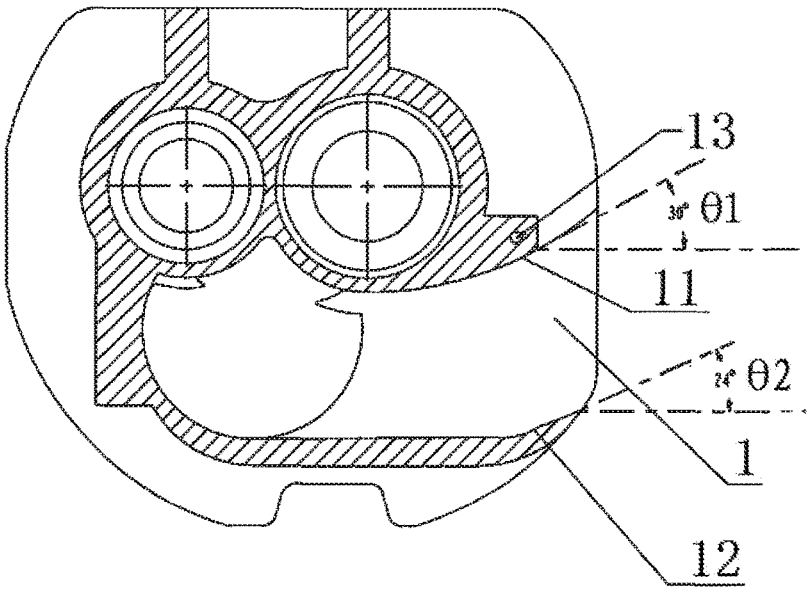
FIG. 2 is a schematic sectional view of the exhaust bearing seat according to the present application.

As shown in FIG. 2, in an exemplary embodiment of the exhaust bearing seat according to the present application, the opening of the exhaust port 1 includes an exhaust port upper edge 11 and an exhaust port lower edge 12. The exhaust port upper edge 11 may be an arc, and an included angle between a tangent line of the arc and a horizontal plane functions as an opening inclination angle θ1 of the exhaust port upper edge 11. The exhaust port lower edge 12 may also be an arc, and an included angle between a tangent line of the arc and a horizontal plane functions as an opening inclination angle θ2 of the exhaust port lower edge 12. A bearing seat oil return hole 13 is provided in the exhaust bearing seat at a position close to the exhaust port upper edge 11.

In order to allow the gas flow to flow sufficiently along a surface of the inner wall of the oil separating barrel, the opening inclination angle θ1 of the exhaust port upper edge 11 should be set as large as possible, but should not cause the exhaust port upper edge 11 to interfere with the bearing seat oil return hole 13. Specifically, the opening, inclination angle θ1 of exhaust port upper edge 11 should be set to ensure that the bearing seat oil return hole 13 has a sufficient safe wall thickness. The opening inclination angle θ2 of the exhaust port lower edge 12 should be smaller than the opening inclination angle θ1 of the exhaust port upper edge 11 by 5 degrees to 10 degrees, which not only allows gas flow to flow obliquely upward, but also facilitates enlarging the exhaust port area and the reducing the flow rate, thereby reducing the resistance loss and the noise.

As the gas flow exhausted from the exhaust port 1 will flow upward along the inner wall of the oil separating barrel, the opening inclination angle θ1 of the exhaust port upper edge 11 of the exhaust port 1 will directly determine the flowing direction of the gas flow when be exhausted from the exhaust bearing seat. The opening inclination angle θ1 of the exhaust port upper edge 11 may range from 25 degrees to 65 degrees, for example 30 degrees.

The opening inclination angle θ2 of the exhaust port lower edge 12 should be smaller than the opening inclination angle θ1 of the exhaust port upper edge 11 by 5 degrees to 10 degrees, for example, the opening inclination angle θ2 of the exhaust port lower edge 12 may be 24 degrees.

Figure 3:
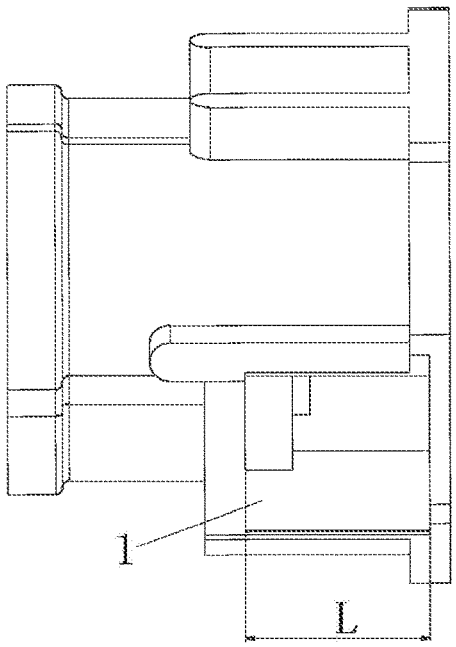
FIG. 3 is a schematic front view of the exhaust bearing seat according to the present application.

As shown in FIG. 3, in the exemplary embodiment of the exhaust bearing seat according to the present application, as long as the exhaust port 1 of the exhaust bearing seat is not overlapped with a discharge port of the oil separating barrel, the axial length L of the exhaust port 1 of the exhaust bearing seat should be set as large as possible so as to achieve a low velocity of flow of the gas flow.

The exhaust bearing seat according to the present application can be applied to a screw compressor.

Figure 4:
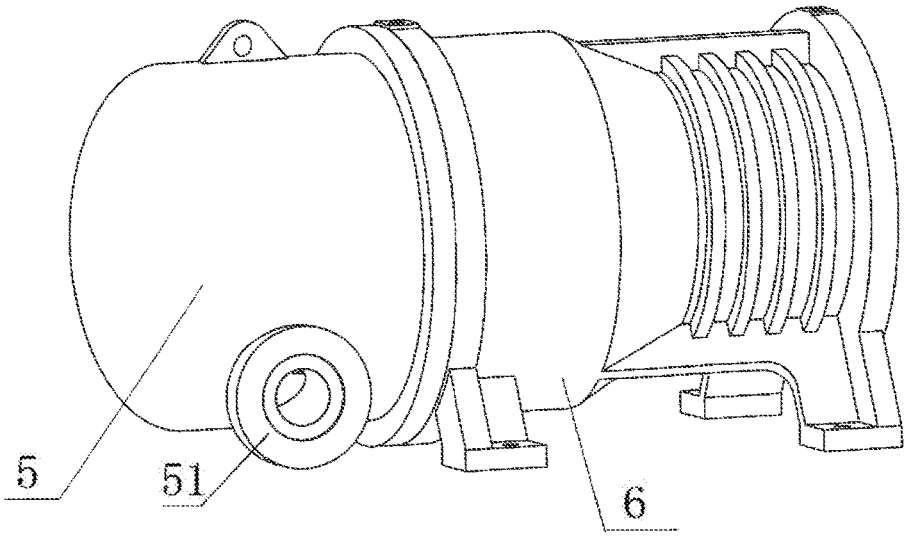
FIG. 4 is a schematic external view showing the structure of a screw compressor according to the present application.

As shown in FIG. 4, in an exemplary embodiment of a screw compressor according to the present application, the screw compressor includes an oil separating barrel 5, a compressor body 6 and an exhaust bearing seat according to any of the above embodiments. The exhaust bearing seat is arranged in the oil separating barrel 5 at an exhaust end of the compressor body 6.

Figure 5:
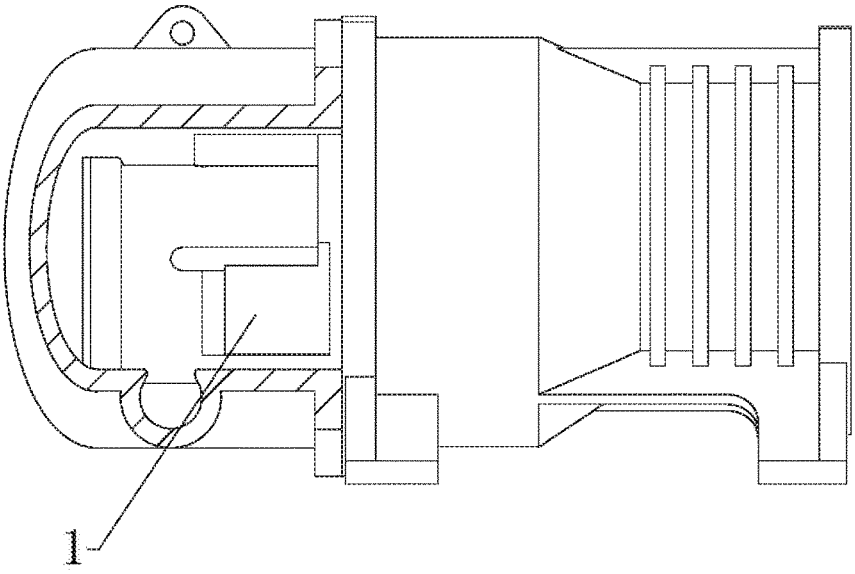
FIG. 5 is a schematic sectional view of the screw compressor according to the present application taken along an axial direction.
Figure 6:
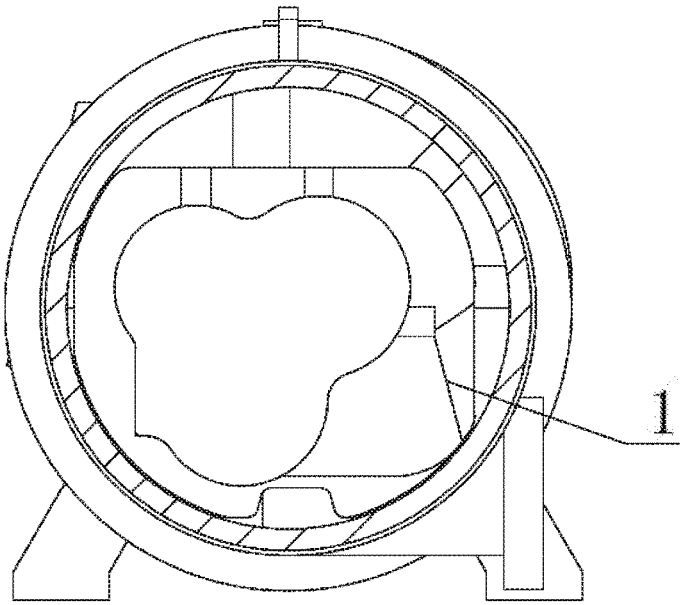
FIG. 6 is a schematic sectional view of the screw compressor according to the present application taken along a radial direction.

The opening of the exhaust port 1 of the exhaust bearing seat can be arranged at the side of the piston chamber 2 and the male rotor bearing chamber 3, and opens towards a radial direction of the exhaust bearing seat, and opens inclined upward in a preset inclination, angle. A discharge port 51 of the oil separating barrel 5 is arranged at the bottom of the oil separating barrel 5 at the side of the piston chamber 2 and the male rotor bearing chamber 3. The discharge port 51 of the oil separating barrel 5 is offset from the opening of the exhaust port 1 of the exhaust bearing seat in a horizontal direction. The exhaust port 1 of the exhaust bearing seat is inclined upward so as to render a velocity to the gas flow, which enables the gas flow exhausted through the exhaust bearing seat to flow along the inner wall of the oil separating barrel 5 (as shown in FIGS. 5 and 6), and then to be discharged via the discharge port 51 of the oil separating barrel 5 after making a complete revolution.

Generally, the flow velocity of the gas flow exhausted from the exhaust port 1 of the exhaust bearing seat is relatively high (>10 m/s), and in the case that the exhaust port 1 of the exhaust bearing seat is configured to have an upward inclination angle, the gas flow may flow along, the inner wall of the oil separating barrel 5 under the guiding of the exhaust port 1 of the exhaust bearing seat.

As the gas flow exhausted from the exhaust bearing seat flows at a certain velocity, and at an upward inclination angle after passing through the exhaust port 1, and further as the gas flow is sheathed in the oil separating barrel, the gas flow can rotationally flow along the inner wall of the oil separating barrel 5 and around the axis of the oil separating barrel 5.

Compared with the conventional technology, in the screw compressor according to the present application, the exhaust port 1 of the exhaust bearing seat is located further away from the discharge port 51 of the oil separating barrel 5. In addition, the exhaust port 1 of the exhaust bearing seat being provided at the side may also allow the gas flow exhausted from the exhaust bearing seat to flow along the inner wall of the oil separating barrel 5 and then be discharged through the discharge port 51 of the oil separating barrel 5, which can reduce the noise caused by the gas exhausted from the exhaust port 1 of the exhaust bearing seat to a certain extent.

The screw compressor according to the present application can be applied to an air-conditioning unit.

In an exemplary embodiment of the air conditioning unit according to the present application, the air-conditioning unit includes the screw compressor according to any one of the above embodiments.

Finally, it should be noted that, the above embodiments are only intended for describing the technical solutions of the present application and should not be interpreted as limitation to the technical solutions of the present application. Although the present application is described in detail in conjunction with the above preferred embodiments, it should be understood by the person skilled in the art that, modifications may still be made to the embodiments of the present application or equivalent substitutions may still be made to part of the technical features of the present application; and any technical solutions and improvements thereof without departing from the spirit and scope of the present application should fall into the scope of the technical solution of the present application defined by the claims.

The invention claimed is:

1. A screw compressor, comprising an exhaust bearing seat, wherein the exhaust bearing seat is provided with an exhaust port, and an opening of the exhaust port is orientated in a way that, in the case that the exhaust bearing seat is sheathed in a housing, gas exhausted from the exhaust port has a component which rotationally flows along an inner wall of the housing and around an axis of the housing, wherein the opening of the exhaust port comprises an exhaust port upper edge and an exhaust port lower edge, the exhaust port upper edge is an arc, and a tangent line of the arc and a horizontal plane form an opening inclination angle θ1 greater than 0 degrees, the exhaust port lower edge is also an arc, and a tangent line of the arc and a horizontal plane form an opening inclination angle θ2 greater than 0 degrees, wherein an oil return hole is provided in the exhaust bearing seat at a position close to the exhaust port upper edge, and the opening inclination angle θ1 of the exhaust port upper edge is a specific value, and the opening inclination angle θ2 of the exhaust port lower edge is smaller than the opening inclination angle θ1 of the exhaust port upper edge by 5 degrees to 10 degrees.

2. The screw compressor according to claim 1, wherein the opening of the exhaust port is orientated to be substantially perpendicular to an axis of a male rotor bearing chamber or an axis of a female rotor bearing chamber in the exhaust bearing seat.

3. The screw compressor according to claim 2, wherein the exhaust port is inclined upward to allow gas flow exhausted through the exhaust port to flow obliquely upward.

4. The screw compressor according to claim 2, comprising an oil separating barrel provided with a discharge port, and the exhaust bearing seat is sheathed in the oil separating barrel.

5. The screw compressor according to claim 1, wherein the exhaust port is inclined upward to allow gas flow exhausted through the exhaust port to flow obliquely upward.

6. The screw compressor according to claim 5, comprising an oil separating barrel provided with a discharge port, and the exhaust bearing seat is sheathed in the oil separating barrel.

7. The screw compressor according to claim 1, wherein the opening inclination angle θ1 of the exhaust port upper edge ranges from 25 degrees to 65 degrees, the opening inclination angle θ2 of the exhaust port lower edge is smaller than the opening inclination angle θ1 of the exhaust port upper edge by 5 degrees to 10 degrees.

8. The screw compressor according to claim 7, comprising an oil separating barrel provided with a discharge port, and the exhaust bearing seat is sheathed in the oil separating barrel.

9. The screw compressor according to claim 1, wherein the opening of the exhaust port is positioned at the side of a male rotor bearing chamber in the exhaust bearing seat.

10. The screw compressor according to claim 1, comprising an oil separating barrel provided with a discharge port, and the exhaust bearing seat is sheathed in the oil separating barrel.

11. The screw compressor according to claim 10, wherein the discharge port of the oil separating barrel is offset from the opening of the exhaust port of the exhaust bearing seat in a horizontal direction.

12. An air-conditioning unit, comprising the screw compressor according to claim 11.

13. An air-conditioning unit, comprising the screw compressor according to claim 1.

* * * * *